US006715402B2

(12) United States Patent
Pfaff et al.

(10) Patent No.: US 6,715,402 B2
(45) Date of Patent: Apr. 6, 2004

(54) HYDRAULIC CONTROL CIRCUIT FOR OPERATING A SPLIT ACTUATOR MECHANICAL MECHANISM

(75) Inventors: Joseph L. Pfaff, Wauwatosa, WI (US); Dwight B. Stephenson, Delafield, WI (US)

(73) Assignee: HUSCO International, Inc., Waukesha, WI (US)

( * ) Notice: Subject to any disclaimer, the term of this patent is extended or adjusted under 35 U.S.C. 154(b) by 160 days.

(21) Appl. No.: 10/082,862

(22) Filed: Feb. 26, 2002

(65) Prior Publication Data

US 2003/0159577 A1 Aug. 28, 2003

(51) Int. Cl.[7] ..... F01B 11/16

(52) U.S. Cl. ..... 91/526; 91/530; 91/531; 91/533

(58) Field of Search ..... 60/403, 406; 91/521, 91/523, 526, 529, 531, 533, 454, 464

(56) References Cited

U.S. PATENT DOCUMENTS 3,430,540 A * 3/1969 Linz ..... 91/454
3,851,566 A * 12/1974 Herrmann ..... 91/526
5,207,059 A 5/1993 Schexnayder
6,161,467 A 12/2000 A'Hearn et al.

* cited by examiner

*Primary Examiner*—F. Daniel Lopez
(74) *Attorney, Agent, or Firm*—George E. Haas; Quarles & Brady LLP

(57) ABSTRACT

A system for simultaneously operating first and second hydraulic cylinders has an inlet node for connection to a source of pressurized fluid and an outlet node for connection to a tank. A two-position, three-way primary control valve has a first port connected to the inlet node, a second port connected to the outlet node, and a common port. A first electrohydraulic proportional valve connects the common port to a first port of the first cylinder, and a second electrohydraulic proportional valve connects the common port to a first port of the second cylinder. A third electrohydraulic proportional valve connects the inlet node to a second port of the first cylinder and a second port of the second cylinder. Selectively operating the primary control valve and one of the third and fourth electrohydraulic proportional valves determines the direction in which the first and second cylinders move. Operation of the first and second electrohydraulic proportional valves meters hydraulic fluid to or from the first and second cylinders to control the rate of that movement.

26 Claims, 6 Drawing Sheets

| MODE \ VALVE | 3-WAY VALVE 22 | 1ST & 2ND EHPV'S 32 & 36 | THIRD EHPV 42 | 4TH EHPV 44 | TANK VALVE 31 |
|---|---|---|---|---|---|
| NORMAL EXTEND | 1 | MFP | 0 | MFP | 0 |
| NORMAL RETRACT | 0 | MFP | MFP | 0 | 0 |
| POWERED REGENERATION EXTEND | 1 | MFP | MFP | 0 | 0 |
| STANDARD FLOAT | 0 | 1 | 0 | 1 | 0 OR 1 |
| UNPOWERED METERED RETRACT | 0 | MFP | 0 | MFP | 0 |
| UNPOWERED METERED EXTEND | 0 | MFP | 0 | 1 | MFP |
| PARTIAL POWERED METERED EXTEND WITH PFC PUMP | 1 | MFP | MFP | 0 | 0 OR 1 |

0 = DE-ENERGIZED
1 = ENERGIZED
MFP = METERED FLOW AND PRESSURE CONTROL

HYDRAULIC CONTROL CIRCUIT FOR OPERATING A SPLIT ACTUATOR MECHANICAL MECHANISM

BACKGROUND OF THE INVENTION

1. Field of the Invention

The present invention relates to hydraulic circuits for operating members of a machine, and more particularly to hydraulic circuits in which multiple actuators are powered in unison to operate a member.

2. Description of the Related Art

Construction and agricultural equipment have moveable members which are operated by actuators, such as hydraulic cylinder and piston arrangements, controlled by hydraulic valves. There is a present trend away from manually operated hydraulic valves in such equipment toward electrical controls and the use of solenoid valves. This type of control simplifies the hydraulic plumbing as the control valves do not have to be located in the operator cab with individual hydraulic lines extending to the actuators located throughout the equipment. The control valves can be located at the actuators with only hydraulic supply and return lines being run throughout the equipment. This change in technology also facilitates control of various machine functions by a computer.

Application of pressurized hydraulic fluid from a pump to the actuator often is controlled by a set of four proportional solenoid valves, such as described in U.S. Pat. No. 5,878,647. When an operator desires to move a member on the equipment, a control lever is operated to generate electrical signals that drive the solenoid valves for the cylinder associated with that member. One solenoid valve is opened to supply pressurized fluid to a cylinder chamber on one side of the piston and another solenoid valve opens to allow fluid to drain from a chamber on the other side of the piston. By varying the degree to which the solenoid valves are opened, the flow of fluid to or from the associated cylinder chamber is metered, thereby controlling that rate of piston movement. One pair of the valves in each set is used to move the actuator and the associated machine member in one direction, and the other valve pair produces movement in the opposite direction.

Machine members that move relatively heavy loads typically are operated by multiple actuators which function in parallel. For example, the boom of a front end loader has a pair of arms each raised and lowered by a separate piston-cylinder arrangement. Thus the load is split between two actuators and the mechanical assembly is referred to as a "split actuator mechanism" or in the case of the front end loader a "split cylinder mechanism." The two cylinders were often controlled by a single control valve assembly connected to the cylinders by hoses. A safety valve had to be provided at each cylinder to prevent the boom from dropping in the event a hose burst. Alternatively, separate sets of four proportional solenoid valves were located at each cylinder and connected thereto by rigid tubing. If a hose bursts in this configuration, the valves could be closed to prevent the boom from dropping. However, this alternative required twice as many control valves in comparison to a single cylinder function and the associated restrictions.

Therefore, a desire exists to reduce the number of hydraulic valves that operate a split cylinder mechanism, while maintaining safe control of the mechanical members of the equipment.

SUMMARY OF THE INVENTION

A hydraulic system is provided to operate first and second actuators, such as the split cylinders of a front end loader, for example. Each of those actuators has first and second ports. The hydraulic system includes a primary control valve that has one port for connection to a source of pressurized hydraulic fluid, another port for connection to a tank for the hydraulic fluid, and a common port. A first control valve selectively connects the common port of the primary control valve to the first port of the first actuator. A second control valve is connected between the common port of the primary control valve and the first port of the second actuator. A third control valve selectively couples both the second port of the first actuator and the second port of the second actuator to the source of pressurized hydraulic fluid. A fourth control valve selectively connects both the second port of the first actuator and the second port of the second actuator to the tank for hydraulic fluid.

To operate the first and second actuators in one direction, the primary control valve is positioned to connect the source of pressurized hydraulic fluid to the common port and the fourth control valve is opened to form a fluid path between the second ports of both the first and second actuators and the tank. The first and second electrohydraulic proportional valves are operated to meter hydraulic fluid into the first and second actuators to control the rate of movement. The degree to which the fourth control valve is opened meters the flow of hydraulic fluid from the actuators.

To operate the first and second actuators in another direction, the primary control valve is positioned to connect the tank to the common port, and the third control valve is opened to form a fluid path between the second ports of both the first and second actuators and the source of pressurized hydraulic fluid. The degree to which the third control valve is opened meter the flow of hydraulic fluid to the first and second actuators, while first and second electrohydraulic proportional valves are operated to meter hydraulic fluid from those actuators.

DETAILED DESCRIPTION OF THE INVENTION

Figure 1:
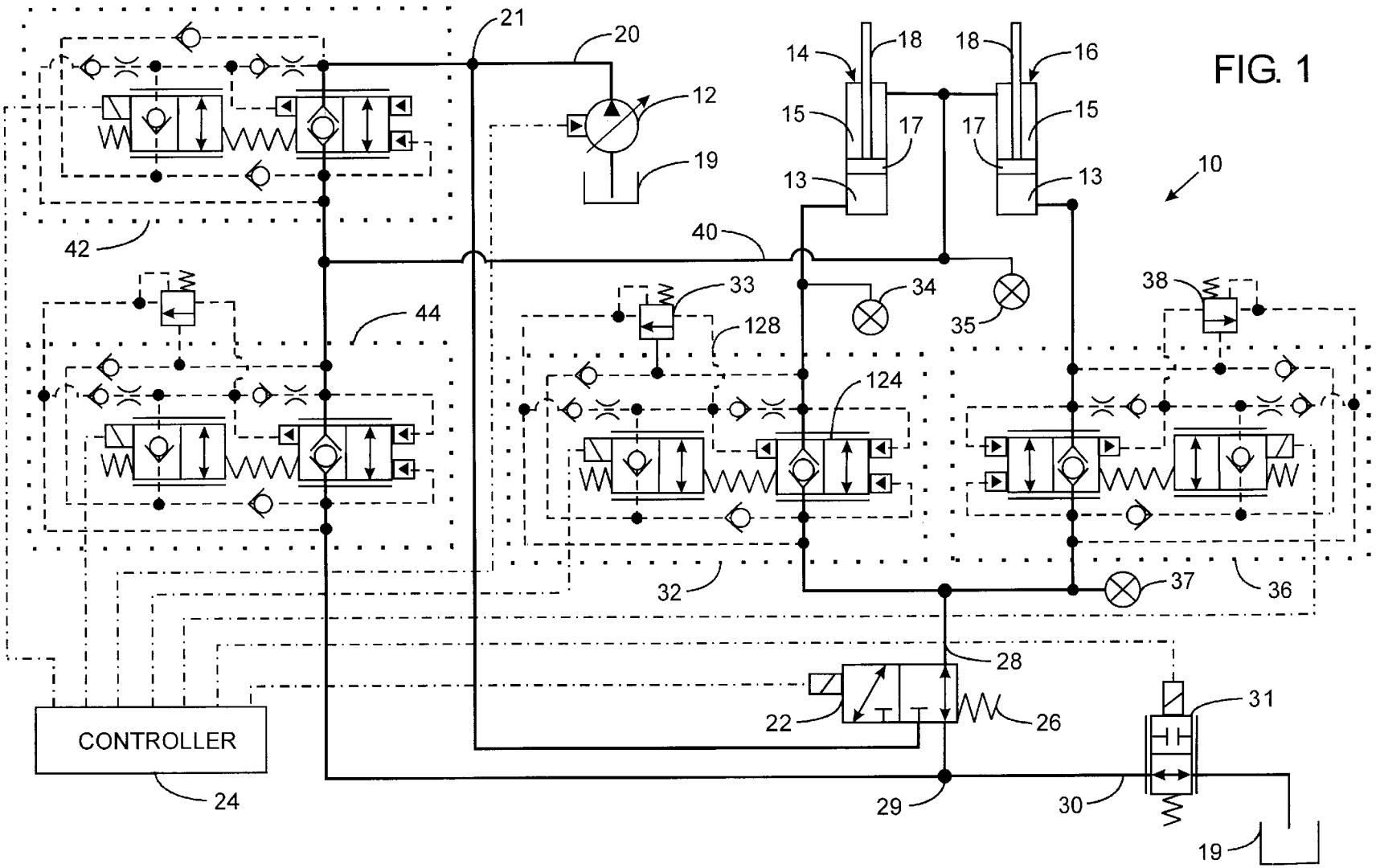
FIG. 1 is a schematic diagram of a hydraulic circuit according to the present invention.

With initial reference to FIG. 1, a hydraulic system 10 controls the flow of pressurized hydraulic fluid supplied by a pump 12 to a pair of actuators, such as first and second hydraulic cylinders 14 and 16. The pump 12 also supplies fluid to other hydraulic functions on the machine. Each hydraulic cylinder has a piston 17 which divides the cylinder into a head chamber 13 and a rod chamber 15. A rod 18 couples the piston 17 to a member on a machine. The first and second hydraulic cylinders 14 and 16 are connected in tandem to jointly operate the machine member. For example, each cylinder may be pivotally connected to the frame of a front end loader with the piston rods being connected to a different one of the boom arms which raise the load bucket.

The hydraulic system 10 also controls the flow of hydraulic fluid from the actuator cylinders 14 and 16 to a reservoir tank 19. For ease of illustration, the tank 19 is shown divided into two components one supplying fluid to the pump 12 and the other at the bottom of the drawing into which the fluid drains from the cylinders, but it will be understood by those skilled in the art that this schematic representation corresponds to a single tank structure. Although for ease of illustration only the components for the split function are shown, it should be understood that the pump 12 and reservoir tank 19 also service other functions on the machine.

The output of the pump 12 is connected by a supply line 20 to an inlet node 21 of a valve assembly which principally comprises a two-position, three-way primary control valve 22 and four electrohydraulic proportional (EHP) valves 32, 36, 42 and 44. Specifically, the inlet node 21 is connected to the primary control valve 22 which is operated by a solenoid. When the solenoid is energized by a signal from a computer controller 24 for the machine on which the hydraulic system 10 is located, the primary control valve 22 is placed into a first position in which the inlet node 21 is connected to a common port of the valve. When the solenoid is de-energized, a spring 26 normally biases the primary control valve 22 into a second position where the common port 28 is connected to an outlet node 29 of the valve assembly. The outlet node 29 is connected by a return line 30 and an optional tank return line valve 31 to the system tank 19. A first pressure sensor 37 produces an electrical signal corresponding to the pressure at the common port 28 and that electric signal is applied as an input to the controller 24.

The common port 28 is connected by a first bi-directional electrohydraulic proportional valve 32 to a port for the head chamber of the first cylinder 14. Typically this EHP valve 32 will be located on the first cylinder 14. A signal from the controller 24 causes the first EHP valve 32 to meter the flow of fluid between the common port 28 of the primary control valve 22 to the head chamber 13 of the first cylinder 14. The magnitude of the flow of hydraulic fluid through the first EHP valve 32 is dependent upon the level of electrical current applied by the controller 24. A second pressure sensor 34 produces an electrical signal corresponding to the pressure in the head chamber 13 of the first cylinder 14 and that electric signal is applied as an input to the controller 24. A mechanical pressure relief valve 33 responds when the pressure in the head chamber of the first cylinder 14 exceeds a given threshold by relieving pressure in a control chamber of the first EHP valve 32 to the tank 19 when the primary control valve 22 is in its normal position.

Figure 2:
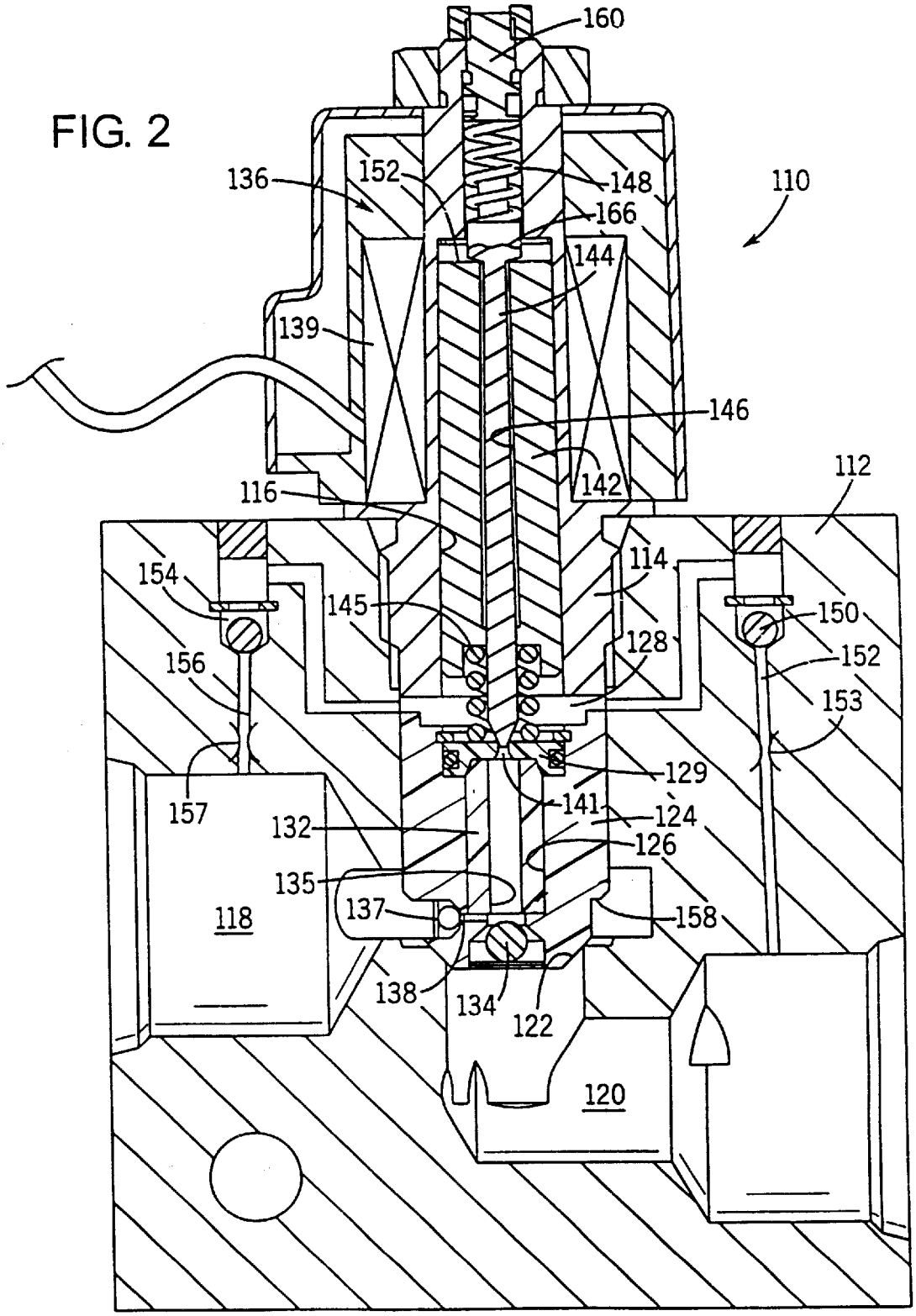
FIG. 2 is a cross section through a bidirectional solenoid operated pilot valve according to the present invention.

FIG. 2 illustrates the details of the preferred embodiment of the first bidirectional, electrohydraulic proportional valve 32, and the other EHP valves 36, 42 and 44 used in the hydraulic system 10. It should be understood that other types of electrohydraulic and non-electrical valves may be used in a hydraulic circuit according to the present invention. The exemplary valve 110 comprises a cylindrical valve cartridge 114 mounted in a longitudinal bore 116 of a valve body 112. The valve body 112 has a transverse first port 118 which communicates with the longitudinal bore 116. A second port 120 extends through the valve body and communicates with an interior end of the longitudinal bore 116. A valve seat 122 is formed between the first and second ports 118 and 120.

A main valve poppet 124 slides within the longitudinal bore 116 with respect to the valve seat 122 to selectively control flow of hydraulic fluid between the first and second ports. A central bore 126 is formed in the main valve poppet 124 and extends from an opening at the second port 120 to a second opening into a control chamber 128 on the remote side of the main valve poppet. A first check valve 134 allows fluid to flow only from the poppet's central bore 126 into the second port 120. A second check valve 137 in the main valve poppet passage 138 limits fluid flow in that passage to only a direction from the poppet bore 126 to the first port 118.

The second opening of the bore 126 in the main valve poppet 124 is closed by a flexible seat 129 with a pilot aperture 141 extending there through. A resilient tubular column 132 biases the flexible seat 129. Opposite sides of the flexible seat 129 are exposed to the pressures in the control chamber 128 and in a pilot passage 135 formed in the main valve poppet 124 by the tubular column 132.

The valve body 112 incorporates a third check valve 150 in a passage 152 extending between the control chamber 128 and the second port 120. The third check valve 150 allows fluid to flow only from the second port 120 into the control chamber 128. A fourth check valve 154 is located in another passage 156 to allow fluid to flow only from the first port 118 to the control chamber 128. Both of these check valve passages 152 and 156 have a flow restricting orifice 153 and 157, respectively.

Movement of the main valve poppet 124 is controlled by a solenoid 136 comprising an electromagnetic coil 139, an armature 142 and a pilot poppet 144. The armature 142 is positioned within a bore 116 through the cartridge 114 and a first spring 145 biases the main valve poppet 124 away from the armature. The pilot poppet 144 is located within a bore 146 of the tubular armature 142 and is biased into the armature by a second spring 148 that engages an adjusting screw 160.

In the de-energized state of the electromagnetic coil 139, the second spring 148 forces the pilot poppet 144 against end 152 of the armature 142, pushing both the armature and the pilot poppet toward the main valve poppet 124. This results in a conical tip of the pilot poppet 144 entering and closing the pilot aperture 141 in the resilient seat 129 and the pilot passage 135, thereby closing fluid communication between the control chamber 128 and the second port 120.

The control valve 110 proportionally meters the flow of hydraulic fluid between the first and second ports 118 and 120. The electric current generates an electromagnetic field which draws the armature 142 into the solenoid 136 and away from the main valve poppet 124. The magnitude of that electric current determines the amount that the valve opens and thus the rate of hydraulic fluid flow through the valve.

Specifically, when the pressure at the first port 118 exceeds the pressure at second port 120, the higher pressure is communicated to the control chamber 128 through the fourth check valve 154. As the armature 142 moves, the head 166 on the pilot poppet 144 is forced away from the main valve poppet 124 opening the pilot aperture 141. That action results in hydraulic fluid flowing from the first port 118 through the control chamber 128, pilot passage 135 and the first check valve 134 to the second port 120. Flow of hydraulic fluid through the pilot passage 135 reduces the pressure in the control chamber 128 to that of the second port 120. Thus the higher pressure in the first port 118, that is applied to the surface 158, forces main valve poppet 124 away from valve seat 122 opening direct communication between the first and second ports 118 and 120. Movement of the main valve poppet 124 continues until a pressure of force balance is established across the main poppet 124 due to constant flow through the orifice 157 and the effective orifice of the pilot opening to the pilot aperture 141. Thus, the size of this valve opening and the flow rate of hydraulic fluid there through are determined by the position of the armature 142 and pilot poppet 144, which in turn controlled by the magnitude of current in electromagnetic coil 139.

When the pressure in the second port 120 exceeds the pressure in the first port 118, proportional flow from the second port to the first port can be obtained activating the solenoid 136. In this case the higher second port pressure is communicated through the third check valve 154 to the control chamber 128 and when the pilot poppet 144 moves away from the pilot seat 129 fluid flows from the control chamber, pilot passage 135 and second check valve 137 to the first port 118. This results in the main valve poppet 124 opening due to the higher pressure acting on its bottom surface.

Referring again to FIG. 1, a second EHP valve 36 couples the common port 28 of the primary control valve 22 to a port for the head chamber 13 of the second cylinder 16. Typically this second EHP valve 36 will be located on the second cylinder 16. A separate electrical signals from the controller 24 regulate the operation of the second EHP valve 36 and the magnitude of the hydraulic fluid flowing there through. A second relief valve 38 is provided to open the second EHP valve 36 in the event of an excessive pressure appearing at the head chamber of the second cylinder 16. It should be noted that the pressure reference lines for both the first and second relief valves 33 and 38 may be connected to the tank return line 29 or directly to the tank 19 instead of to the common port 28 of the primary control valve 22.

It should be noted that the first and second EHP valves 32 and 36 typically are located in close proximity to the two cylinders 14 and 16. In fact, the first and second EHP valves 32 and 36 preferably are mounted directly on the cylinder with a rigid tube connected there between forming a relatively burst-proof connection. As noted previously, the gravitational forces acting on the cylinders tend to push them downward in the orientation shown in FIG. 1 so as to force hydraulic fluid out of the head chambers of each cylinder. Therefore, in the event that a hydraulic hose ruptures elsewhere in the hydraulic system 10 as indicated by the pressure monitored by first, second, or third sensor 37, 34 or 35, the first and second EHP valves 32 and 36 will be closed to hold the load supported by the cylinders 14 and 16.

The ports for rod chambers 15 of the first and second cylinders 14 and 16 are both connected to a common hydraulic line 40 which extends to third and fourth EHP valves 42 and 44. A third pressure sensor 35 produces an electrical signal representing the pressure in the rod chambers 15 and that electric signal is applied as an input to the controller 24. The third EHP value 42 couples the hydraulic line 40 to the output of the pump 12 via inlet node 21. The fourth EHP valve 44 connects the hydraulic line 40 from the rod chambers of cylinders 14 and 16 to the tank return line 30 via outlet node 29. These latter EHP valves 42 and 44 are operated by separate electrical signals from the controller 24, as will be described.

The direction of the movement of the hydraulic cylinders 14 and 16 is determined by the position of the primary control valve 22 and which one of the third and fourth EHP valves 42 and 44 is open. Operation of the first and second EHP valves 32 and 36 meters the flow fluid between the primary control valve 22 and the two cylinders 14 and 16. Whereas eight EHP valves previously were used to control the operation of a pair of split hydraulic cylinders, the present hydraulic system 10 employs only five valves, four bidirectional EHP valves 32, 36, 42 and 44 and one two-position, three-way primary control valve 22.

Figures 3, 4:
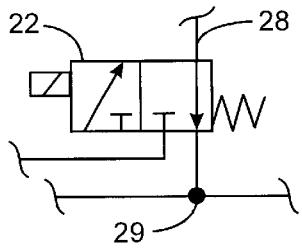
FIG. 3 is a table depicting the states of the valves in FIG. 1 for different operating mode of the hydraulic circuit
FIG. 4 depicts an alternative valve for use in the hydraulic circuit in FIG. 1.

Furthermore, this valve assembly has multiple modes of operation as depicted by the table in FIG. 3. The first two are conventional modes in which the rod extends or retracts from the cylinder. In the normal extend mode, the primary control valve 22 is energized so that the fluid supply line 20 is coupled to the common port 28 of the valve and thus to the first and second EHP valves 32 and 36. The controller 24 energizes the first and second EHP valves 32 and 36 to meter the flow of hydraulic fluid to the head chambers 13 of both the cylinders 14 and 16. While this is occurring, the controller 24 also monitors the pressure as indicated by the signal from the second pressure sensor 34. At the same time, the fourth EHP valve 44 is energized to couple the rod chambers 15 of cylinders 14 and 16 to the tank return line 30 so that, as the rod 18 extends farther from the cylinders, fluid forced from the rod chambers flows to the tank return line 30. The fourth EHP valve 44 is operated by the controller 24 to meter that return flow. In this normal extend mode, the third EHP valve 42 is maintained in the closed state. The controller 24 also monitors the rod chamber pressure indicated by the signal from the third pressure sensor 35.

In the normal retract mode, the third EHP value 42 is energized by the controller 24 to meter the flow of fluid received from the pump 12 at the inlet node, to the rod chambers 15 of both hydraulic cylinders 14 and 16. The primary control valve 22 is de-energized in this mode and is positioned by the spring 26 where the common port 28 is connected to the tank return line 30. Therefore, activation of the first and second EHP valves 32 and 36 by the controller 24 meters the flow of fluid from the head chambers 13 of cylinders 14 and 16 through the primary control valve 22 to the tank 19. This causes the pistons 17 to retract the rods 18 into the first and second cylinders 14 and 16.

If the hydraulic system 10 will only be operated in the normal extend and retract modes, the primary control valve 22 may be replaced by a unidirectional two-position valve illustrated in FIG. 3. The primary control valve 22 in either FIG. 1 or 3 may be a pilot operated type valve.

Referring still to FIGS. 1 and 3, the hydraulic system 10 also has a powered regeneration extend mode of operation in which the three-way, primary control valve 22 is energized to connect the pump supply line 20 to the port 28. The controller 24 then activates the first and second EHP valves 32 and 36 to meter the flow fluid from the supply to the head chambers of the two cylinders 14 and 16. However, unlike the normal extend mode, the powered regeneration extend mode maintains the fourth EHP valve 44 closed so that the fluid being forced from the rod chambers of the cylinders 14 and 16 does not flow to the tank return line 30. Instead, the controller 24 operates the third EHP 42 valve to meter the fluid from the cylinder rod chambers to the inlet node 21 where that fluid combines with fluid supplied by pump 12. Thus fluid exhausted from the rod chambers 15 of the cylinders 14 and 16 is recycled and used to fill the cylinder head chambers 13. Because the rod chambers 15 are smaller than the head chambers, the additional fluid required to fill the larger volume head chambers is furnished by the pump 12. Likewise the required fluid supply from the pump 12 to obtain a given cylinder speed is greatly reduced.

A standard float mode also can be provided in which fluid is able to flow freely between the rod and head chambers of the cylinders 14 and 16. One version of the hydraulic system to implement this mode optionally requires the addition of the tank return line valve 31 which when energized completely isolates or proportionally meters the isolation between the outlet node 29 of the valve assembly from the tank 19. The tank return line valve 31 may be an EHP valve such as the one shown in FIG. 2. With that tank isolation existing, the solenoid of the primary control valve 22 is de-energized so that its common port 28 is connected to the valve assembly outlet node 29. At this time both of the first and second EHP valves 32 and 36 are opened to provide a fluid path from the head chambers of the cylinders 14 and 16. The fourth EHP valve 44 also is opened by the controller 28 so that the cylinder rod chambers also are connected to the valve assembly outlet node 29. Thus depending upon the direction of the load force exerted on the cylinders 14 and 16, fluid is able to flow between the head and rod chambers 13 and 15. The tank return line valve 31 is required so if the cylinders are extending while in this mode, return fluid can be diverted from the pump or other functions of the system to prevent cavitation in the head chambers 13. The purpose of the tank return line valve 31 may be served by a restriction in the line between the outlet node 29 and the tank 19. Furthermore if cavitation in the head chambers is acceptable, then neither alternative is required for the float mode.

With continuing reference to FIGS. 1 and 3, an unpowered regeneration retract mode can be used when force acting on the cylinder load tends to force fluid out of the head chambers 13. In this condition, the rods 18 can be retracted in a controlled manner without hydraulic power from the pump 12 by operating the first and second EHP valves 32 and 36 to meter fluid from the cylinder head chambers 13 to the three-way valve 22 which is de-energized so that the fluid flows to the outlet node 29 of the valve assembly. The fourth EHP valve 44 is opened by the controller 24. On a typical machine, the outlet node 29 is coupled to the tank 19 by a relatively long hydraulic hose which forms the tank return line 30. As a result of the flow resistance of that long hose, the fluid at the outlet node 29 tends to flow toward the fourth EHP valve 44 as that is the path of least resistance. Thus, by opening the fourth EHP valve 44, the fluid being exhausted from the cylinder head chambers 13 flows into the rod chambers of cylinders 14 and 16. The excess fluid exhausted from the head chambers, beyond that which is required to fill the smaller volume rod chambers, flows through the tank return line 30 to the tank 19. In applications where the tank return line 30 presents a relatively low resistance path, the controller 24 can meter the flow in that line via operation of a proportional tank return valve 31.

Figure 5:
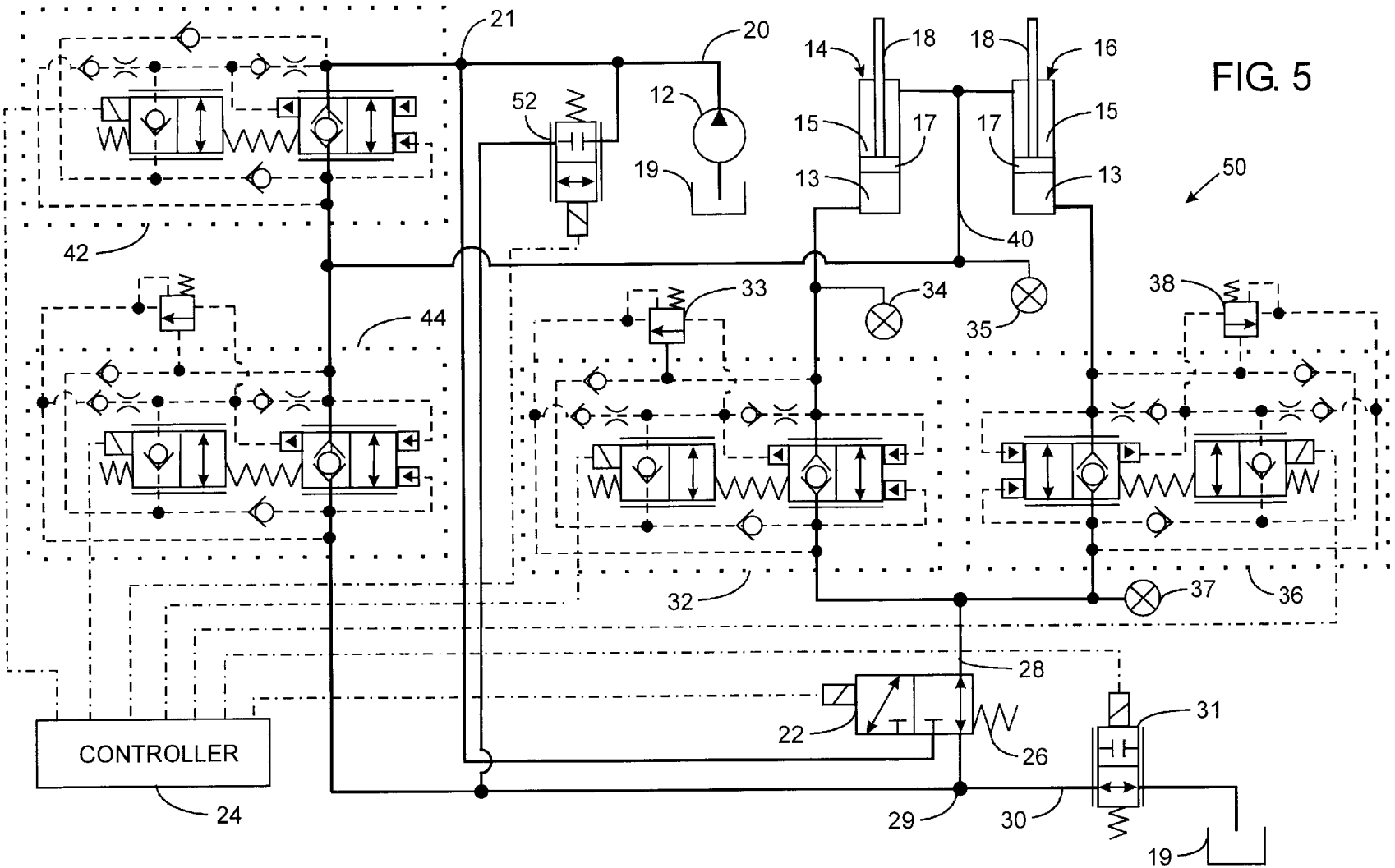
FIG. 5 is a schematic diagram of another hydraulic circuit according to the present invention.

FIG. 5 illustrates a second hydraulic system 50 which has a fixed displacement pump 12 and an unloader valve 52 between the pump supply line 20 and the outlet node 29 of the valve assembly. This embodiment of the present invention can be utilized when the gravitational or other forces acting on the cylinders 14 and 16 tend to extend the rods 18, thereby tending to force fluid out of the rod chambers 15 enabling a unpowered regeneration extend mode. This fluid from the rod chambers 15 is then metered through the fourth EHP valve 44 to the outlet node 29 of the valve assembly. The third EHP valve 42 is de-energized, i.e. in the closed state, and the tank return valve 31 is controlled proportionally. The three-way primary control valve 22 also is maintained de-energized, thereby coupling the outlet node 29 to the common port 28 and thus to both the first and second EHP valves 32 and 36. Those latter valves 32 and 36 are operated by the controller 24 to meter the flow of hydraulic fluid into the head chambers 13 of the cylinders 14 and 16. Because the head chambers 13 require a greater volume of fluid than is being exhausted from the rod chambers, bypass flow through the unloader valve 52 or return flow from other functions is pressurized by the proportional closure of the tank return line valve 31

Referring again to FIG. 1, a partially powered metered extend mode can be utilized with a variable displacement pump 12, in which the signal from the second pressure sensor 34 is used by the controller 24 in governing the displacement and thus the output pressure of the pump. In this mode, the three-way primary control valve 22 is energized connecting the inlet node 21 to the valve's common port 28, thus supplying pressurized fluid to the first and second EHP valves 32 and 36. The first and second EHP valves 32 and 36 are then operated by the controller to meter the flow of fluid into the head chambers of the two cylinders 14 and 16. This action forces fluid from the rod chambers 15 of the cylinders into the hydraulic line 40. The controller 24 activates the third EHP valve 42 to meter the flow from those rod chambers to the inlet node 21 from which it is added to fluid flowing from the variable displacement pump 12. The controller 24 responds to the pressure signal from the second sensor 34 by regulating the displacement of the pump 12 to maintain the necessary pressure to extend the rods from the cylinders 14 and 16. This action also supplies the fluid differential required to expand the larger head chambers.

Figure 6:
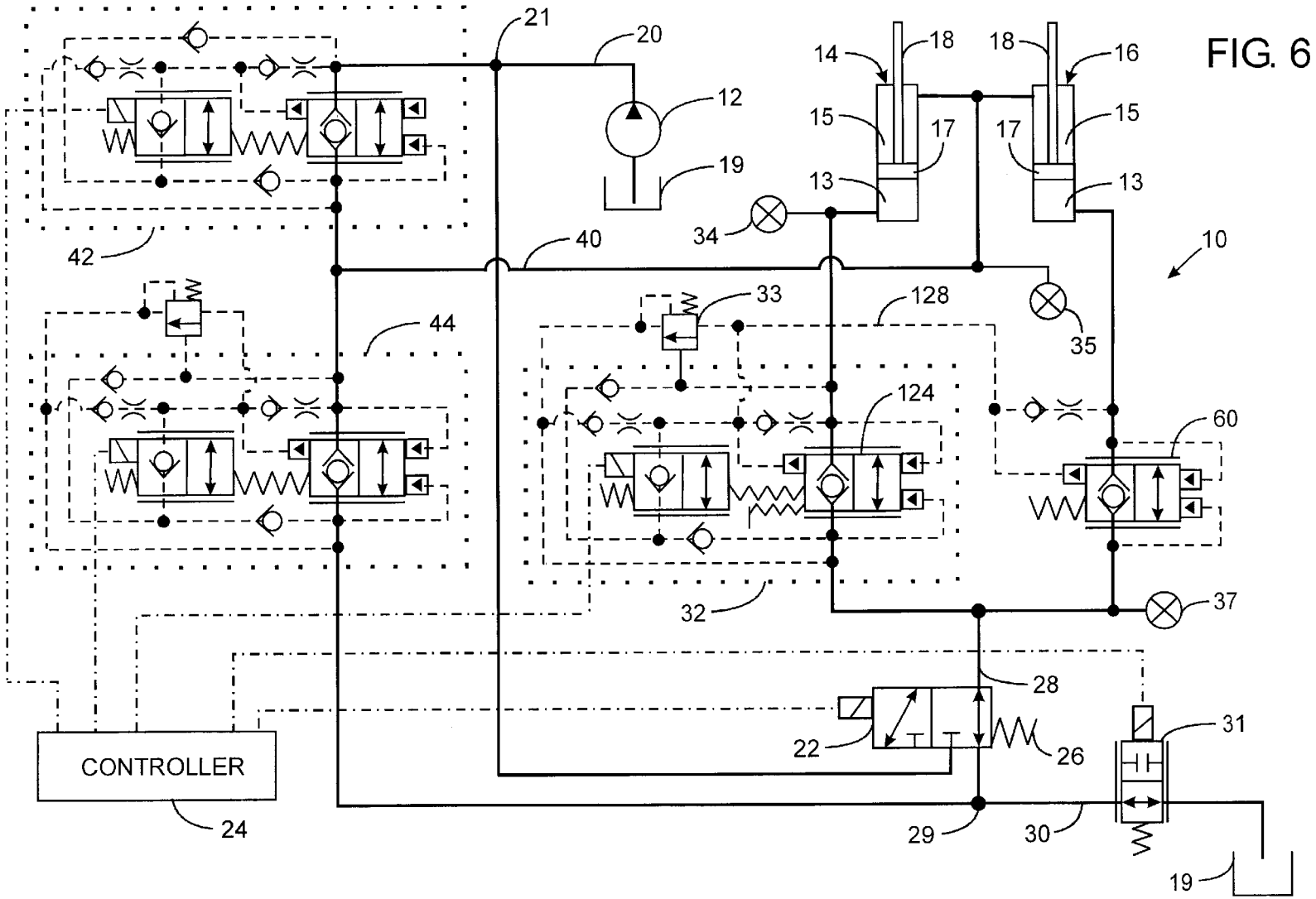
FIG. 6 is a schematic diagram of a hydraulic circuit which is similar to that in FIG. 1 with one of the electrohydraulic control valves replaced by a shadow poppet valve.

With reference to FIG. 6, another embodiment of the present invention is similar to that shown in FIG. 1 and like components have been given identical reference numerals. The second electrohydraulic proportional valve 36 has been replaced by a shadow poppet valve 60 which couples head chamber 13 of the second actuator 16 to the common port 28 of the primary control valve 22. The poppet operates in response to the pressure in the control chamber 128 of the first EHP valve 32 in the same manner as the main poppet 124 of the first EHP valve operates. Thus, the poppet valve 60 opens and closes in unison with the main poppet 124 of the first EHP valve 32. Both valves 32 and 60 open proportional amounts in response to activation of the first EHP valve 32 by controller 24. Therefore, control valves 32 and 60 provide similar metering of hydraulic fluid between the common port 28 and the head chamber of their respective actuators 14 and 16.

Figure 7:
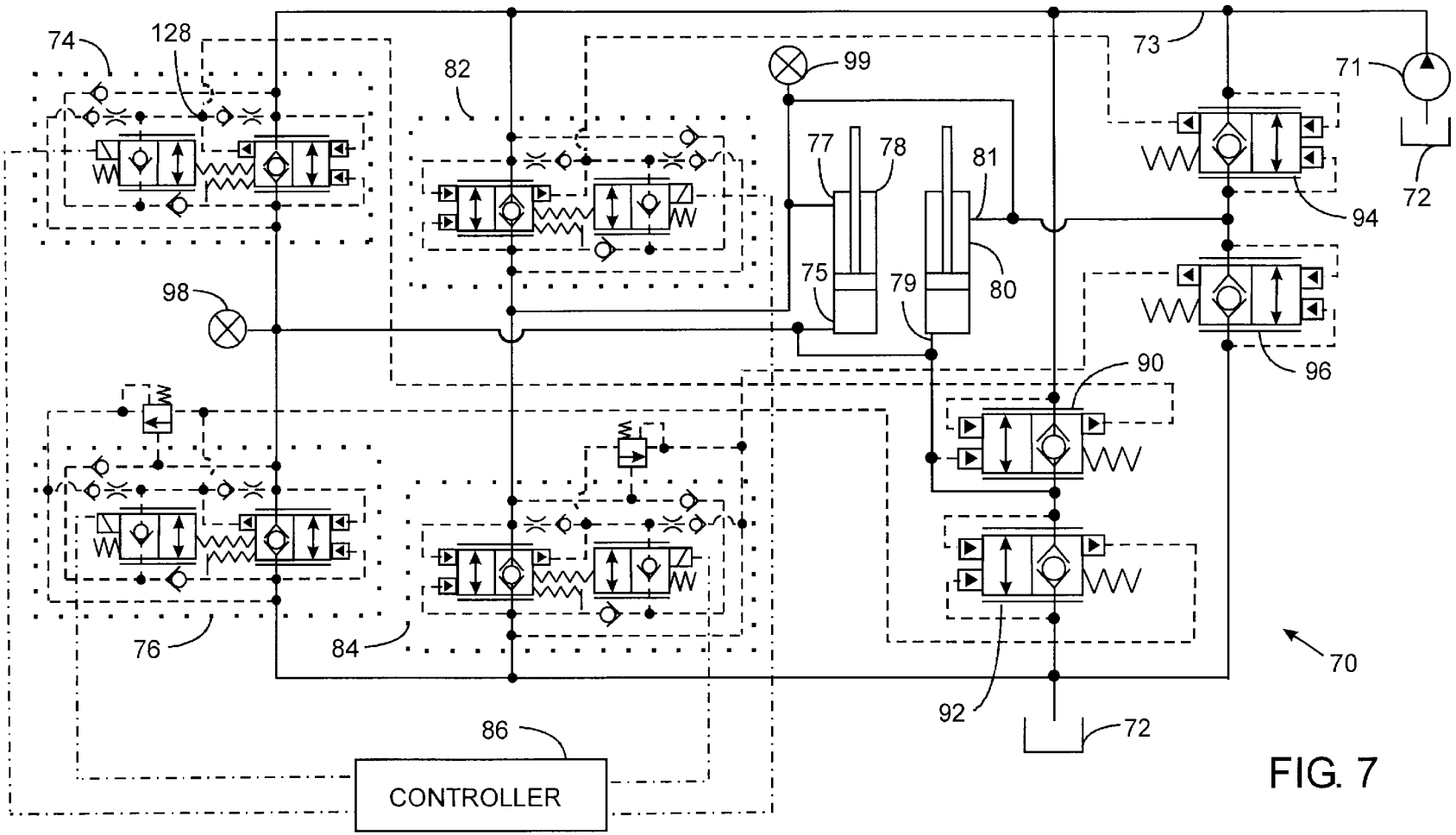
FIG. 7 is a schematic diagram of another hydraulic circuit which employs four electrohydraulic control valves and shadow poppet valves.

FIG. 7 illustrates another embodiment of a system 70 for controlling split actuators with a reduced number of electrohydraulic valves. In this hydraulic system 70, fluid is drawn from tank 72 by a pump 71 and fed into a supply line 73. A pilot operated first control valve 74 couples the pressurized fluid from the supply line 73 to a first port 75 of a first actuator 78. This first port 75 is associated which the head chamber of the first actuator 78 and also is selectively coupled by a pilot operated second control valve 76 to the tank 72. A pilot operated third control valve 82 connects the output of the pump 71 to a second port 77 for the rod chamber of the first actuator 78. A pilot operated fourth control valve 84 also selectively connects the second port 77 to the system tank 72. The first, second, third and fourth control valves 74, 76, 82 and 84 have structures similar to that shown in FIG. 2.

Pressure in a control chamber 128 of the pilot operated first control valve 74 is applied to operate a first poppet valve 90 which controls flow of pressurized fluid from the pump 71 to a first port 79 of a second actuator 80. That first port 79 is associated with the head chamber of the second actuator 80. The control chamber of the pilot operated second control valve 76 is applied to operate a second poppet valve 92, which when activated couples the first port 79 of the second actuator 80 to the tank 72. The control chamber 128 of the pilot operated third control valve 82 is coupled to operate a third pilot valve 94 which when opened provides a fluid path between the pump 71 and the second port 81 of the second actuator 80. Similarly, pressure in the control chamber 128 of the pilot operated fourth control valve 84 is applied to operate a fourth poppet valve 96 which when opened provides a path between the second port 81 of the second actuator 80 and the tank 72.

When activated by a controller 86, the pilot operated first control valve 74 opens to conduct pressurized fluid from pump 71 into the head chamber of the first actuator 78. The pressure in the control chamber 128 of the first control valve 74 also causes the first poppet valve 90 to open by a corresponding amount. This connects the head chamber of the second actuator 80 to the fluid supply line 73. The first control valve 74 and the first poppet valve 90 meter pressurized fluid to the head chambers of both actuators 78 and 80 which tends to raise their pistons.

At this time, the controller 86 also activates the pilot operated fourth control valve 84 which then couples the second port 77 of the first actuator 78 to the tank 72, thereby allowing fluid in that actuator's rod chamber to drain to the tank. The pressure in the control chamber of the pilot operated fourth control valve 84 produces a shadow opening of the fourth poppet valve 96 which provides a path between the second port 81 of the second actuator 80 and the tank 72. This combined operation of the first and fourth control valves 74 and 84 along with the first and fourth poppet valves 90 and 96 raises the pistons in the two actuators 78 and 80.

The pistons can be lowered when the controller 86 opens the pilot operated second control valve 76 to provide a path through which fluid from the head chamber of the first actuator 78 can be exhausted to tank 72. The pressure in the control chamber 128 of the second control valve 76 also causes the second poppet valve 92 to open by a corresponding amount. This opening of the second poppet valve 92 allows fluid in the head chamber of the second actuator 80 to flow to the tank 72. While this is occurring, the pilot operated third control valve 82 is activated to meter pressurized hydraulic fluid from the pump 71 to the rod chamber of the first actuator 78. That activation also produces shadow operation of the third poppet valve 94 which meters pressurized fluid to the second port 81 of the second actuator 80.

All the metering modes described above and depicted in FIG. 3 are available in the split actuator system 70 shown in FIG. 7. This embodiment has the advantages of employing only four electrohydraulic valves to control two actuators, being capable of load holding in both directions, and only requiring two work port pressure sensors 98 and 99.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. A hydraulic system for operating first and second actuators each having first and second ports, said hydraulic system comprising:

a primary control valve having one port for connection to a source of pressurized hydraulic fluid, another port for connection to a tank for hydraulic fluid, and a common port;

a bidirectional first control valve connecting the common port of the primary control valve to the first port of the first actuator;

a bidirectional second control valve connecting the common port of the primary control valve to the first port of the second actuator;

a third control valve connecting both the second port of the first actuator and the second port of the second actuator to the source of pressurized hydraulic fluid; and a fourth control valve connecting both the second port of the first actuator and the second port of the second actuator to the tank for hydraulic fluid.

2. The hydraulic system as recited in claim 1 wherein the primary control valve is a two-position, three-way valve.

3. The hydraulic system as recited in claim 1 wherein the primary control valve has a first position in which the one port is connected to the common port, and a second position in which the other port is connected to the common port.

4. The hydraulic system as recited in claim 1 wherein the first control valve, the second control valve, the third control valve, and the fourth control valve are proportional valves.

5. The hydraulic system as recited in claim 1 further comprising:

a first mode of operation in which the primary control valve couples the source of pressurized hydraulic fluid to the common port, the first, second and fourth control valves are open, and the third control valve is closed; and a second mode of operation in which the primary control valve couples the tank for hydraulic fluid to the common port, the first, second and third control valves are open, and the fourth control valve is closed.

6. The hydraulic system as recited in claim 5 wherein in at least one of the first and second modes of operation, the first and second control valves are operated to meter flow of fluid.

7. The hydraulic system as recited in claim 5 wherein in the first mode of operation, the fourth control valve is operated to meter flow of fluid.

8. The hydraulic system as recited in claim 5 wherein in the second mode of operation, the third control valve is operated to meter flow of fluid there through.

9. The hydraulic system as recited in claim 1 further comprising a mode of operation in which the primary control valve couples the tank for hydraulic fluid to the common port, the first, second and fourth control valves are open, and the third control valve is closed.

10. The hydraulic system as recited in claim 1 wherein the third control valve and the fourth control valve are bidirectional valves.

11. The hydraulic system as recited in claim 10 further comprising:

a first mode of operation in which the primary control valve couples the source of pressurized hydraulic fluid to the common port, the first, second and third control valves are open, and the fourth control valve is closed;

a second mode of operation in which the primary control valve couples the tank for hydraulic fluid to the common port, the first, second and fourth control valves are open, and the third control valve is closed; and a float mode of operation in which the primary control valve couples the tank for hydraulic fluid to the common port, the first, second and fourth control valves are open, and the third control valve is closed.

12. The hydraulic system as recited in claim 1 wherein the first control valve, the second control valve, the third control valve, and the fourth control valve are electrohydraulic proportional pilot valves.

13. The hydraulic system as recited in claim 1 further comprising a proportional return line control valve coupling the hydraulic system to the tank for hydraulic fluid.

14. The hydraulic system as recited in claim 1 further comprising an unloader valve coupling the hydraulic system to the source of pressurized hydraulic fluid.

15. The hydraulic system as recited in claim 1 wherein the primary control valve, the first control valve, the second control valve, the third control valve, and the fourth control valve are electrically operated.

16. The hydraulic system as recited in claim 15 further comprising an electronic controller operatively connected to the primary control valve, the first control valve, the second control valve, the third control valve, and the fourth control valve.

17. A hydraulic system for operating first and second actuators each having first and second ports, said hydraulic system comprising:

an inlet node for connection to a source of pressurized hydraulic fluid;

an outlet node for connection to a tank for hydraulic fluid;

a primary control valve having a common port and being connected to the inlet node and the outlet node, wherein the primary control valve has a first position in which the inlet node is connected to the common port and has a second position in which the outlet node is connected to the common port;

a bidirectional first proportional valve connected between the common port of the primary control valve and the first port of the first actuator;

a bidirectional second proportional valve connected between the common port of the primary control valve and the first port of the second actuator;

a third proportional valve connected between the inlet node and both the second port of the first actuator and the second port of the second actuator; and a fourth proportional valve connected between the inlet node and both the second port of the first actuator and the second port of the second actuator.

18. The hydraulic system as recited in claim 17 further comprising a proportional return line control valve selectively coupling the hydraulic system to the tank for hydraulic fluid.

19. The hydraulic system as recited in claim 17 further comprising an unloader valve selectively coupling the source of pressurized hydraulic fluid to the outlet node.

20. The hydraulic system as recited in claim 17 wherein the first proportional valve, the second proportional valve, the third proportional valve, and the fourth proportional valve are electrohydraulic valves.

21. The hydraulic system as recited in claim 17 wherein the first proportional valve, the second proportional valve, the third proportional valve, and the fourth proportional valve are pilot valves.

22. The hydraulic system as recited in claim 17 wherein the third proportional valve and the fourth proportional valve are bidirectional valves.

23. A hydraulic system for operating first and second cylinders each having first and second ports, said hydraulic system comprising:

an inlet node for connection to a source of pressurized hydraulic fluid;

an outlet node for connection to a tank for hydraulic fluid;

a hydraulic line connected to both the second port of the first cylinder and the second port of the second cylinder;

a primary control valve having a common port and being connected to the inlet node and the outlet node, wherein the primary control valve has a first position in which the inlet node is connected to the common port and has a second position in which the outlet node is connected to the common port;

a bidirectional first electrohydraulic proportional valve selectively connecting the common port of the primary control valve to the first port of the first cylinder;

a bidirectional second electrohydraulic proportional valve selectively connecting the common port of the primary control valve to the first port of the second cylinder;

a bidirectional third electrohydraulic proportional valve selectively connecting the hydraulic line to the inlet node; and a bidirectional fourth electrohydraulic proportional valve selectively connecting the hydraulic line to the outlet node.

24. The hydraulic system as recited in claim 23 further comprising a proportional return line control valve selectively coupling the outlet node to the tank for hydraulic fluid.

25. The hydraulic system as recited in claim 23 further comprising an unloader valve selectively coupling the inlet node to the outlet node.

26. The hydraulic system as recited in claim 23 wherein the first proportional valve, the second proportional valve, the third proportional valve, and the fourth proportional valve are pilot valves.

* * * * *